US008777443B2

(12) United States Patent
Yang

(10) Patent No.: US 8,777,443 B2
(45) Date of Patent: Jul. 15, 2014

(54) SPLIT TYPE LED LAMP

(76) Inventor: Kuo-Fu Yang, Taipei (TW)

( * ) Notice: Subject to any disclaimer, the term of this patent is extended or adjusted under 35 U.S.C. 154(b) by 411 days.

(21) Appl. No.: 13/323,889

(22) Filed: Dec. 13, 2011

(65) Prior Publication Data

US 2013/0148342 A1 Jun. 13, 2013

(51) Int. Cl.

| | |
|---|---|
| ***F21L 4/08*** | (2006.01) |
| ***F21L 4/02*** | (2006.01) |
| ***F21S 4/00*** | (2006.01) |
| ***H01R 33/22*** | (2006.01) |
| ***H01R 33/06*** | (2006.01) |
| ***H01R 33/94*** | (2006.01) |
| ***H01R 33/945*** | (2006.01) |
| ***F21S 9/02*** | (2006.01) |
| ***H01R 13/717*** | (2006.01) |
| *F21Y 101/02* | (2006.01) |
| *F21Y 103/00* | (2006.01) |

(52) U.S. Cl.

CPC .. *F21L 4/08* (2013.01); *F21L 4/027* (2013.01); *F21S 4/008* (2013.01); *F21S 9/022* (2013.01); *F21Y 2101/02* (2013.01); *F21Y 2103/003* (2013.01); *H01R 33/225* (2013.01); *H01R 13/7175* (2013.01); *Y10S 362/80* (2013.01)

USPC ..... 362/183; 362/184; 362/249.05; 362/646; 362/650; 362/652; 362/657; 362/800

(58) Field of Classification Search

CPC ..... F21S 9/022; F21S 9/02; F21S 8/035; F21S 4/003; F21S 4/008; F21S 48/215; F21S 48/1154; F21S 48/1159; F21Y 2101/02; F21Y 2111/002; F21Y 2103/003; F21Y 2113/005; F21Y 2105/001; F21Y 2111/005; F21Y 2111/007; F21Y 2101/025; F21Y 2015/008; H02J 7/0044; Y10S 362/80; Y02B 20/383; Y02B 20/36; H05K 2201/10106; H01R 13/7175

USPC ..... 362/20, 183, 184, 249.02, 249.05, 646, 362/649–659, 800; 320/114, 115

See application file for complete search history.

(56) References Cited

U.S. PATENT DOCUMENTS

| | | | | |
|---|---|---|---|---|
| 6,805,461 | B2 * | 10/2004 | Witte | 362/169 |
| 7,140,746 | B2 * | 11/2006 | Chen | 362/199 |
| 7,273,293 | B2 * | 9/2007 | Dalton et al. | 362/183 |
| 7,300,173 | B2 * | 11/2007 | Catalano et al. | 362/208 |
| 7,344,270 | B2 * | 3/2008 | Kim | 362/205 |
| 7,677,745 | B2 * | 3/2010 | Chien | 362/84 |
| 8,427,059 | B2 * | 4/2013 | Betsuda et al. | 315/32 |
| 8,540,414 | B2 * | 9/2013 | Hu | 362/650 |
| 2010/0290207 | A1 * | 11/2010 | Chan et al. | 362/20 |
| 2011/0122609 | A1 * | 5/2011 | Dahlin | 362/184 |

* cited by examiner

*Primary Examiner* — Alan Cariaso
(74) *Attorney, Agent, or Firm* — Leong C. Lei

(57) ABSTRACT

A split type LED lamp includes a base and a lamp body. The lamp body has an LED light board, a second plug portion, a battery slot and a battery, and the LED light board has a plurality of LED light sources and a wireless signal receiver. After the base and the lamp body are combined and installed to a lamp holder for receiving electric power and being used as a lamp bulb, or the lamp body is removed and used as a flashlight independently. In addition, the battery can be replaced to reduce unnecessary waste of resources, and the wireless signal receiver is provided for receiving a wireless control signal transmitted from a remote controller or a mobile communication device to drive the lamp body to emit light and improve the convenience of use.

7 Claims, 6 Drawing Sheets

SPLIT TYPE LED LAMP

BACKGROUND OF THE INVENTION

1. Field of the Invention

The present invention relates to the technical field of illumination apparatuses, in particular to a split type LED lamp structure that can combine a base and a lamp body for the use as a lamp, or use the lamp body independently as a flashlight.

2. Brief Description of the Related Art

As the use of light emitting diode (LED) as an illumination light source becomes increasingly more popular, and the LED has the advantages of a long service life, a power saving feature, and a low pollution, LED lamps are considered as a key to the revolution of the illumination industry. At present, the general LED illumination products available in the market includes traffic lights, warning signs, lamp decorations, advertising billboards for commercial purposes, and many others.

However, the LED is an illumination source with a concentrated spot, and a smaller illumination angle, and thus a special design is required for providing sufficient illumination angle and range for the use as a household LED lamp bulb, and particularly a conventional screw thread of the lamp bulb is required for connecting an electric connecting portion or a positive or negative pole of the electric connecting portion, or inserting into a general lamp holder to receive electric power in order to emit light. Similar to the conventional lamp bulbs available in the market, the LED lamp bulbs cannot be used in a power failure, and thus the present existing LED lamp bulbs fail to meet user requirements.

Therefore, the inventor of the present invention provides a split type LED lamp structure capable of combining a base and a lamp body into a lamp bulb to be installed in a lamp holder for its use, or capable of using the lamp body and the base separately, and the electric power of a built-in battery of the lamp body is provided for driving the lamp body to emit light and used as a flashlight. Therefore, regardless of having or not having electric power, the split type LED lamp of the present invention can be used continuously.

SUMMARY OF THE INVENTION

In view of the drawbacks of the prior art, it is a primary objective of the present invention to provide a split type LED lamp with a simple structure and an easy installation, wherein the lamp can be installed onto a general lamp holder and used as a lamp bulb, as well as removing the lamp body during a power failure, such that the lamp body can be used as a flashlight, so as to enhance the practicality of the product.

To achieve the aforementioned objective, the present invention provides a split type LED lamp comprising: a base, having an electric connecting portion disposed at an end, a containing groove formed at the other end, and a drive circuit board installed in the base and electrically coupled to the electric connecting portion, and the drive circuit board being installed in the containing groove and has a first plug portion; and a lamp body, installed in the containing groove of the base and electrically coupled to the drive circuit board, and comprising: an LED light board, having a plurality of LED light sources disposed on a side of the LED light board, and a wireless signal receiver installed on the other side of the LED light board, for receiving a wireless control signal transmitted from an electronic device to switch the electric power supply of the LED light board; a second plug portion, disposed on a side of the lamp body, and electrically coupled to the LED light board; a battery slot, formed on a side of the lamp body and electrically coupled to the LED light board and the second plug portion; and a battery, installed in the battery slot; thereby after the second plug portion of the lamp body and the first plug portion in the base are electrically coupled to each other, the LED light board is driven to emit light and charge the battery. Therefore, after the lamp body can be contained in the base and installed to a general lamp holder, the lamp body can be used as a lamp bulb, while charging the battery of the lamp body. During a power failure, the lamp body and the base can be separated, and the electric power of the built-in battery of the lamp body can be used for emitting light and use it as a flashlight. The invention can be selectively combined or separated to provide more choices of use of the users and more practical applications of the LED lamp.

In a preferred embodiment, the electric connecting portion follows a screw thread specification or an insert pin specification, such that the electric connection portion is screwed or plugged into a general lamp holder for receiving electric power for its use.

In a preferred embodiment, the lamp body is substantially in a spherical structure, and the containing groove of the base is in a hemispherical shape corresponding to the lamp body; or the lamp body is a strip structure, and the containing groove is substantially in a strip shape corresponding to the lamp body for the use in different occasions and lamp holders.

In a preferred embodiment, the first plug portion is a protruding column, and the second plug portion is a groove, such the first plug portion can be plugged into the second plug portion to complete an electric connection, or the first plug portion is a groove, and the second plug portion is a protruding column, such that the second plug portion can be plugged into the first plug portion to complete an electric connection to facilitate the connection of the lamp body and the base.

In a preferred embodiment, the second plug portion further includes a plug switch electrically coupled to the battery and the LED light board, such that after the lamp body is separated from the base, the electric power of the battery can be used for driving the LED light board to emit light, so that the lamp body can be removed from the base during a power failure, and used as a flashlight independently.

The technical characteristics and effects of the present invention will become apparent by the detailed description of the preferred embodiments together with the illustration of related drawings as follows:

BRIEF DESCRIPTION OF THE INVENTION

DETAILED DESCRIPTION OF THE PREFERRED EMBODIMENTS

Figure 1:
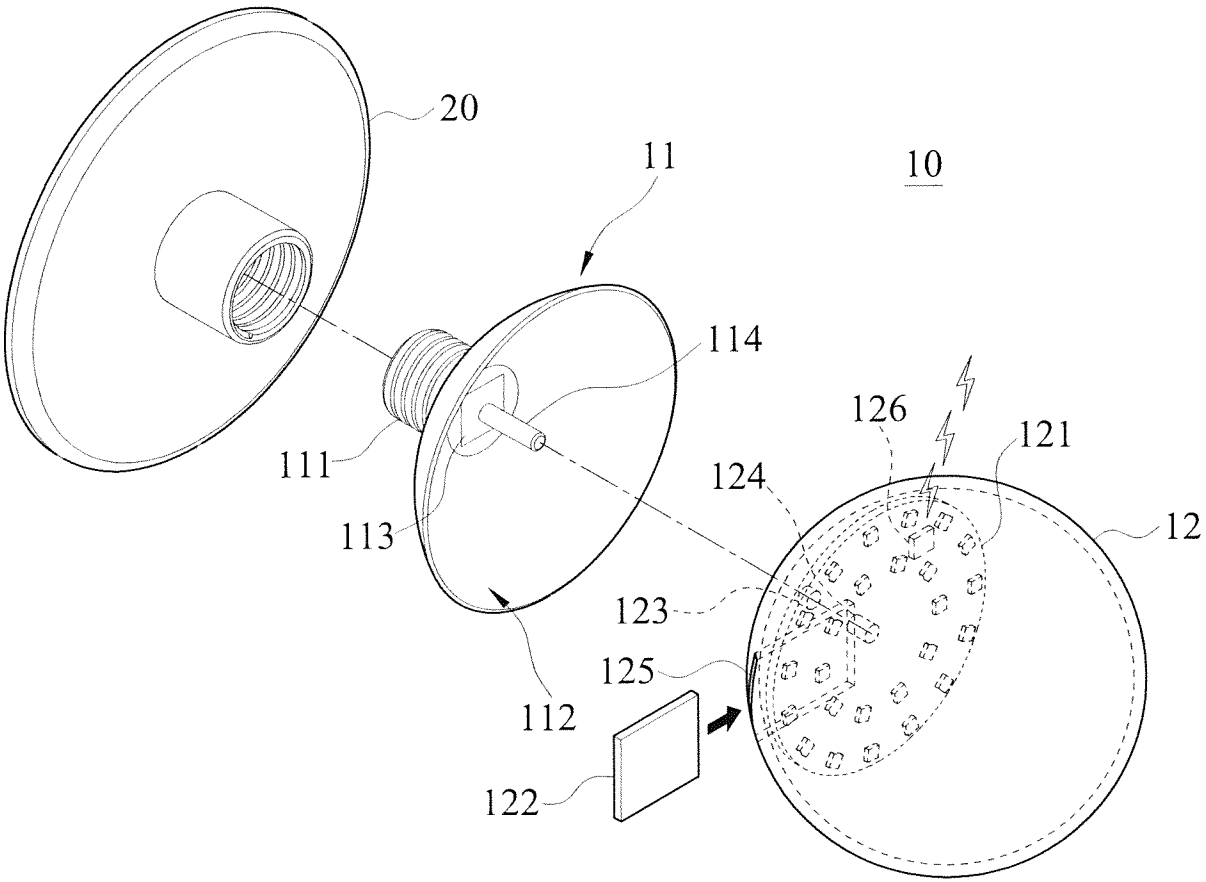
FIG. 1 is an exploded view of a first preferred embodiment of the present invention.

The present invention will become apparent from the detailed description of the following preferred embodiments and related drawings.

With reference to FIGS. 1 to 5 for exploded views of first and second preferred embodiment of the present invention, a perspective view, and cross-sectional views of the first and second preferred embodiments of the present invention respectively, the split type LED lamp 10 of the present invention is installed in a lamp holder 20 for receiving electric power to emit light or charge a battery. The split type LED lamp 10 comprises a base 11 and a lamp body 12.

Wherein, the base 11 includes an electric connecting portion 111 disposed at an end of the base 11 and corresponding to the lamp holder 20 and a containing groove 112 formed at the other end of the base 11 and is in a hemispherical shape corresponding to the lamp body 12, and the base 11 includes a drive circuit board 113 installed therein and provided for supplying voltage and current for a stable input power, and the drive circuit board 113 is electrically coupled to the electric connecting portion 111, and the drive circuit board 113 has a first plug portion 114 formed on an internal side of the containing groove 112 and electrically coupled to the drive circuit board 113. It is noteworthy to point out that the electric connecting portion 111 follows a screw thread specification or an insert pin specification to be screwed or plugged into the lamp holder 20 to obtain the required power of the drive circuit board 113 to fit different models of the lamp holder 20.

The lamp body 12 is substantially a spherical structure contained in the containing groove 112 of the base 11 to constitute the form of a lamp bulb, and the lamp body 12 includes an LED light board 121, a battery 122 and a second plug portion 123, wherein the LED light board 121 has a plurality of LED light sources (not labeled in the figure), so that the LED light board 121, the battery 122 and the second plug portion 123 are electrically coupled to one another. In addition, after the lamp body 12 is electrically coupled to the first plug portion 114 in the base 11 through the second plug portion 123, electric power passing through the lamp holder 20 is inputted to the drive circuit board 113 of the base 11. After the first plug portion 114 and the second plug portion 123 are coupled, the voltage and current of the electric power are regulated to drive the LED light board 121 of the lamp body 12 to charge the battery 122. In addition, the second plug portion 123 further includes a plug switch 124 electrically coupled to the battery 122 and the LED light board 121, such that after the lamp body 12 and the base 11 are separated from each other, the electric power of the battery 122 drives the LED light board 121 to emit light. It is noteworthy to point out that the battery 122 has a specific service life, and the level of the battery power will drop gradually, so that the inventor of the present invention provides a battery slot 125 formed on a side of the lamp body 12 and electrically coupled to the LED light board 121 and the second plug portion 123 for plugging, unplugging or replacing the battery 122, so as to overcome the drawback of the conventional LED lamp that cannot replace its battery 122, and results in an exchange of the lamp body 12. If the lamp body 12 is used as a flashlight, the inventor of the present invention further proposes the concept of controlling the LED lamp to emit light from a remote end by designing a wireless signal receiver 126 on the LED light board 121, and the wireless signal receiver 126 is provided for receiving a wireless control signal transmitted from an electronic device (such as a remote controller or a mobile communication device) to switch and control the LED light board 121 to be turned on or off.

Therefore, after the lamp body 12 of the present invention is contained in the base 11, the lamp body 12 is combined with the base 11 to become a lamp bulb to be installed in a general lamp holder 20 for receiving electric power for its use. In the meantime, the battery 122 of the lamp body 12 is charged. During a power failure or at night time, the lamp body 12 is removed from the base 11 for separate use. After the lamp body 12 and the base 11 are separated, the plug switch 124 automatically starts to charge the built-in battery 122 of the lamp body 12 and drive the LED light board 121 to emit light, so that the lamp body 12 can be used as a flashlight.

Figure 2:
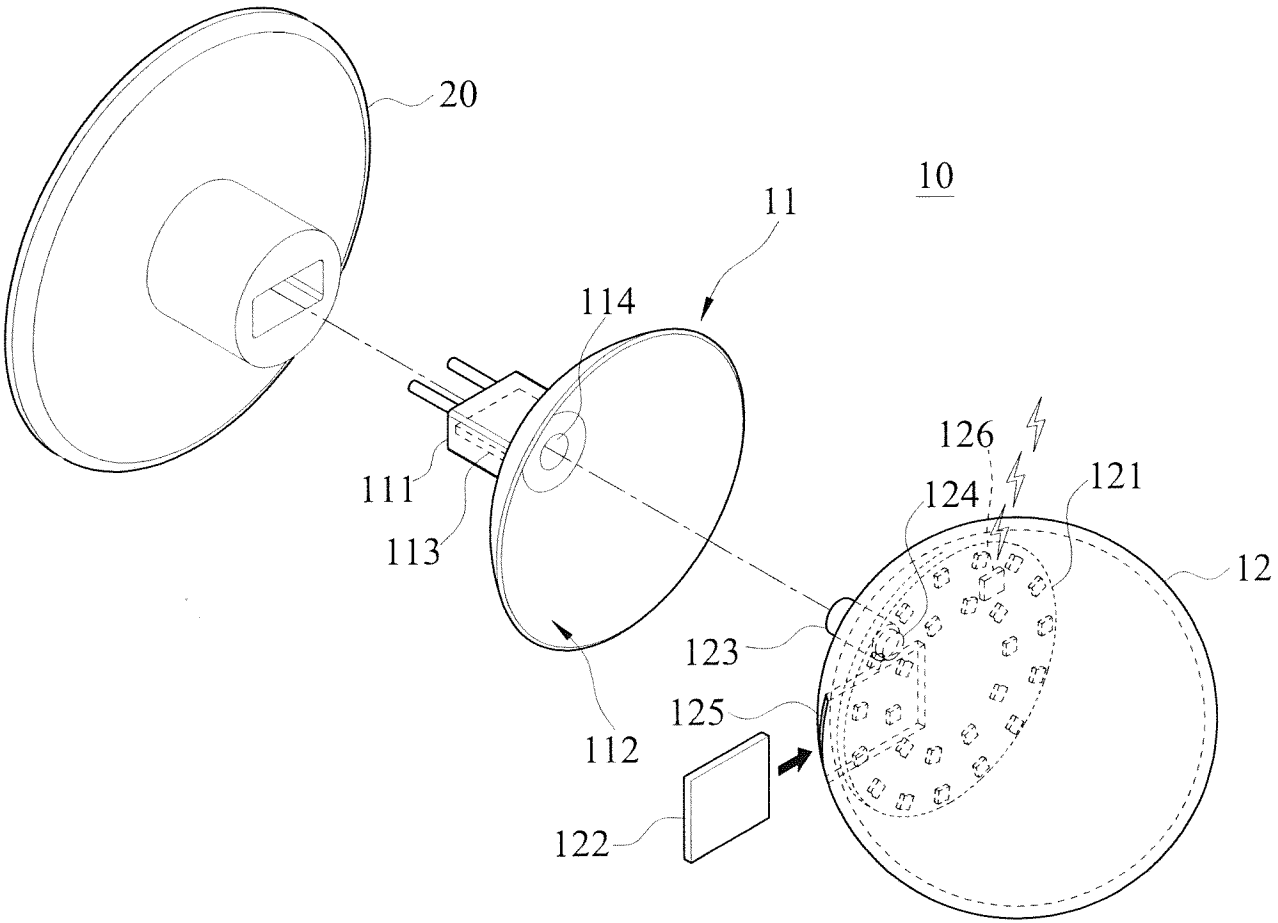
FIG. 2 is an exploded view of a second preferred embodiment of the present invention.
Figure 3:
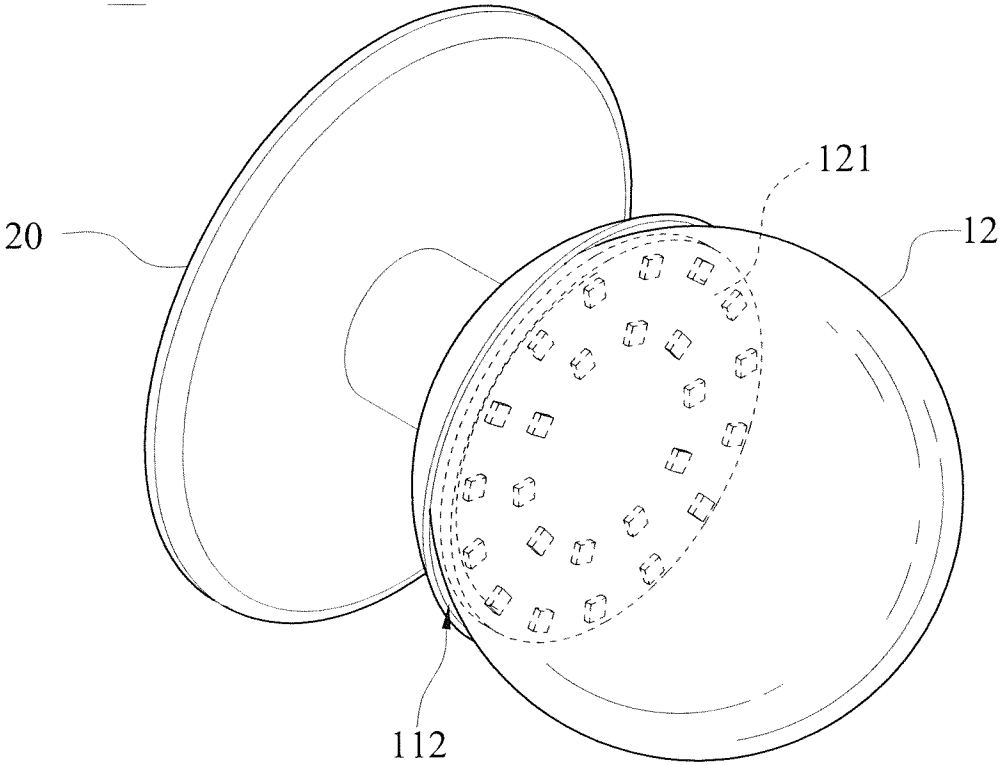
FIG. 3 is a perspective view of a preferred embodiment.
Figure 4:
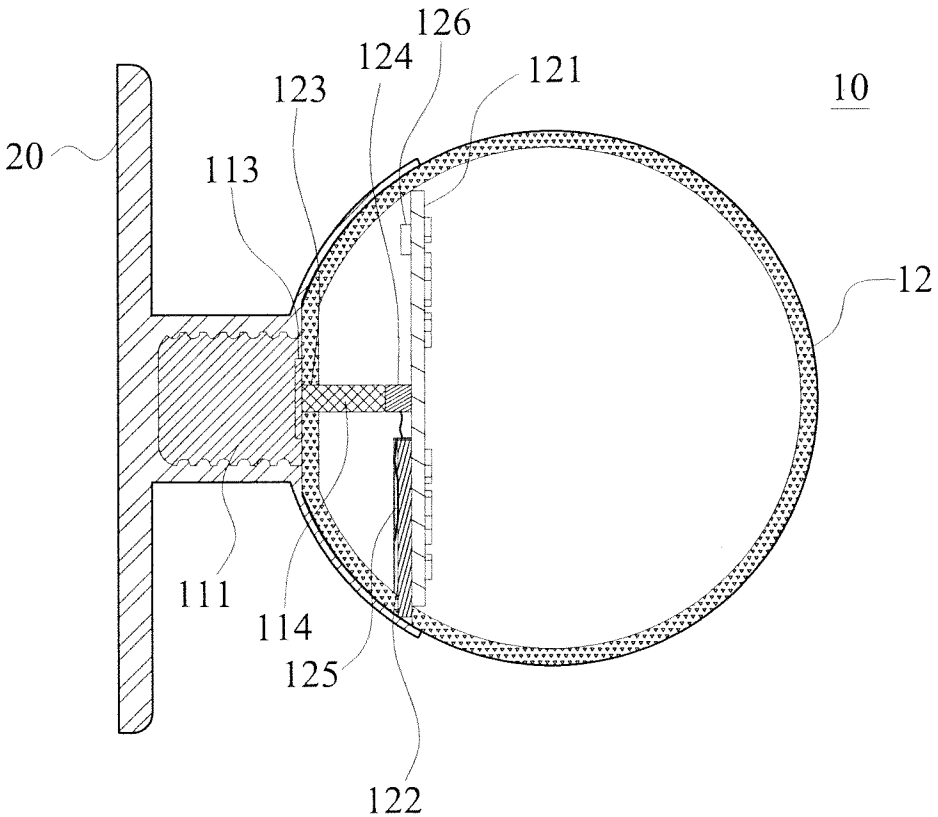
FIG. 4 is a cross-sectional view of the first preferred embodiment of the present invention.
Figure 5:
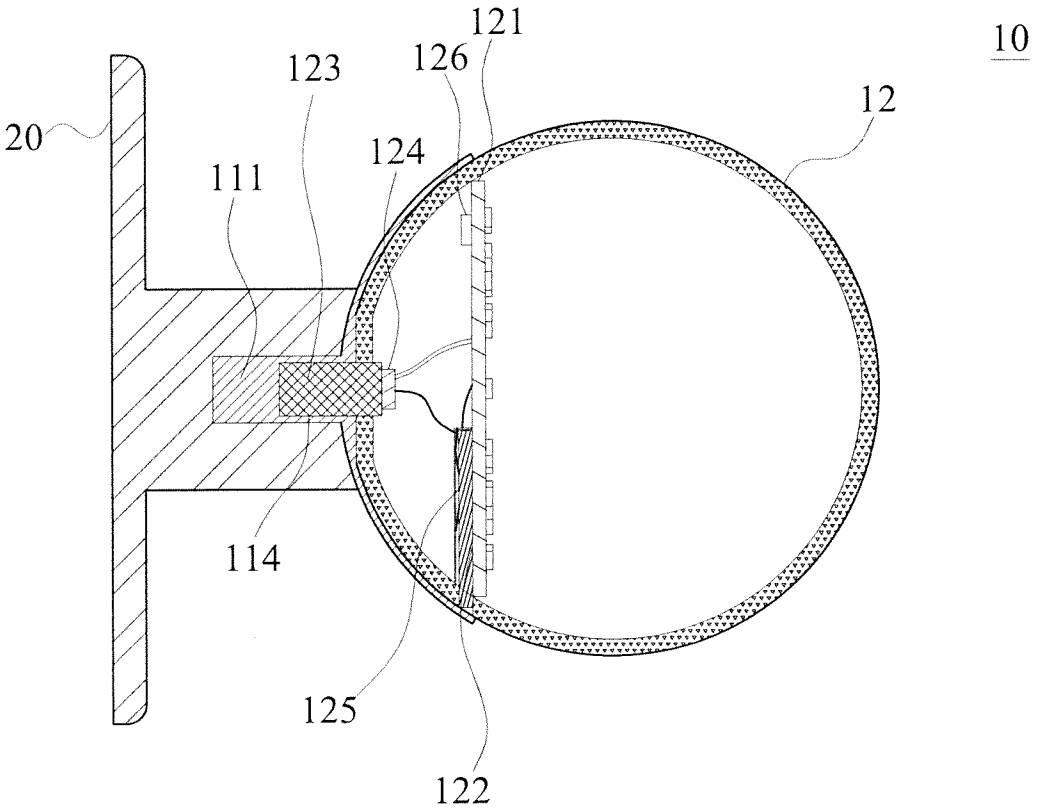
FIG. 5 is a cross-sectional view of the second preferred embodiment of the present invention.

In FIGS. 1 and 4, the first plug portion 114 is a protruding column, and the second plug portion 123 is a groove, such that the first plug portion 114 can be inserted into the second plug portion 123 to complete the electric connection; or in FIGS. 2 and 5, the first plug portion 114 is a groove and the second plug portion 123 is a protruding column, such that the second plug portion 123 can be inserted into the first plug portion 114 to complete an electric connection to facilitate connecting the lamp body 12 and the base 11.

Figure 6:
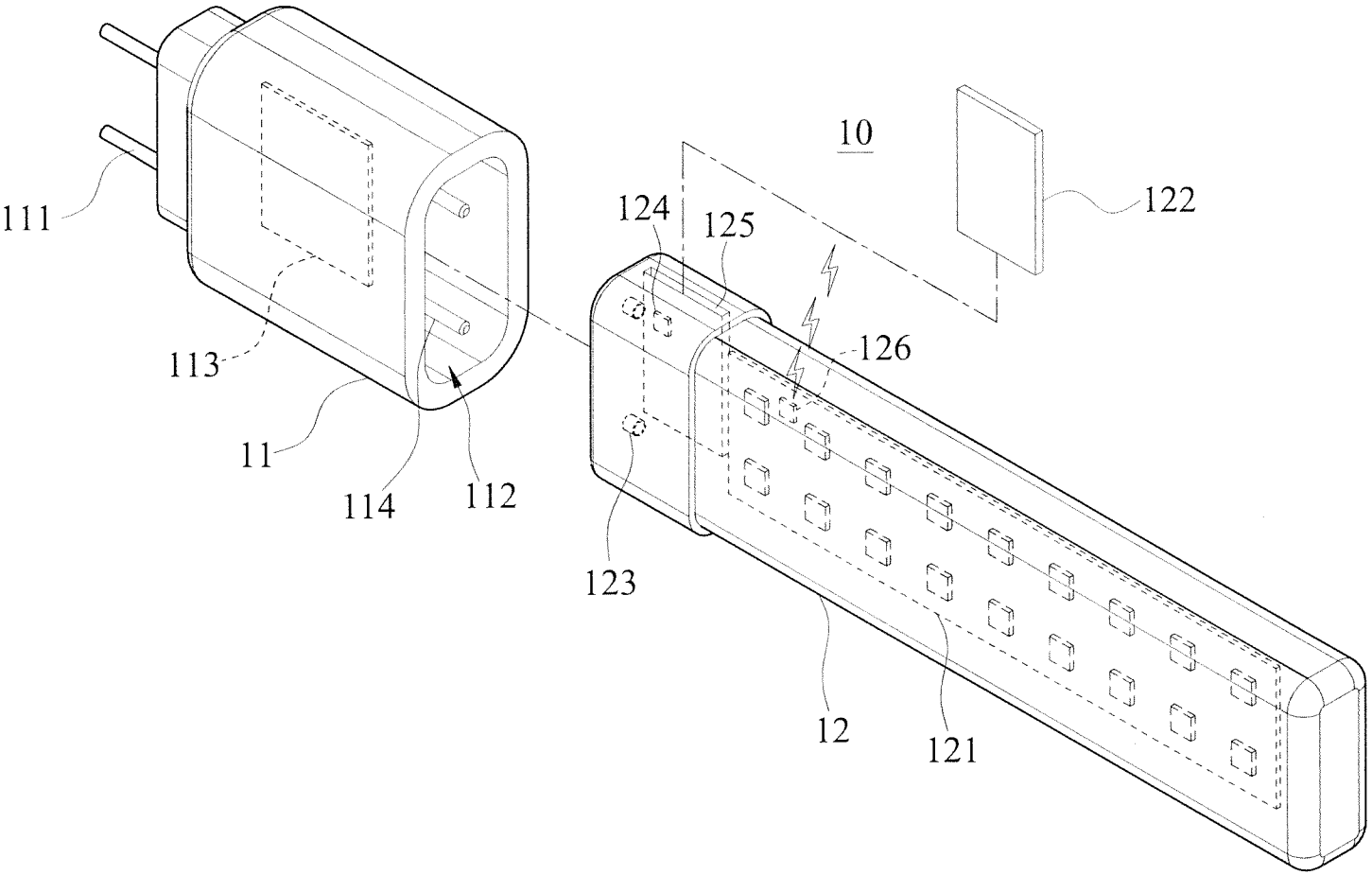
FIG. 6 is a schematic view of a third preferred embodiment of the present invention.

With reference to FIG. 6 for a schematic view of the third preferred embodiment of the present invention, this preferred embodiment shows another example of the present invention, wherein the lamp body 12 is a strip structure, and the containing groove 112 of the base 11 is substantially in a strip shape corresponding to the lamp body 12, and the remaining components are the same as those illustrated in FIG. 1, the lamp body 12 is inserted into the containing groove 112 of the base 11 to complete an electric connection between the first plug portion 114 and the second plug portion 123. After the lamp body 12 is plugged into a general lamp holder 20, the lamp body 12 can be used as a lamp bulb. After the lamp body 12 is removed from the base 11, the lamp body 12 can be used as a flashlight. In this preferred embodiment, the battery slot 125 and the wireless signal receiver 126 are also provided, and the connections are the same as the aforementioned preferred embodiment, and thus will not be described.

While the invention has been described with reference to a preferred embodiment thereof, it is to be understood that modifications or variations may be easily made without departing from the spirit of this invention, which is defined in the appended claims.

What is claimed is:

1. A split type LED lamp, comprising:

a base, having an electric connecting portion disposed at an end, a containing groove formed at the other end, and a drive circuit board installed in the base and electrically coupled to the electric connecting portion, and the drive circuit board having a first plug portion corresponding to the containing groove; and a lamp body, installed in the containing groove of the base, and electrically coupled to the drive circuit board, and comprising:

an LED light board, having a plurality of LED light sources arranged on a surface of the LED light board, and a wireless signal receiver installed on the other side of the LED light board, for receiving a wireless control signal transmitted from an electronic device, and switching an electric power supply of the LED light board;

a second plug portion, disposed on a side of the lamp body, and electrically coupled to the LED light board;

a battery slot, formed on a side of the lamp body, and electrically coupled to the LED light board and the second plug portion; and a battery, installed in the battery slot; thereby, after the second plug portion of the lamp body and the first plug portion in the base are electrically coupled to each other, the LED light board is driven to emit a light and charge the battery.

2. The split type LED lamp of claim 1, wherein the electric connecting portion is one selected from the collection of a screw thread specification and an insert pin specification.

3. The split type LED lamp of claim 1, wherein the lamp body is substantially a spherical structure, and the containing groove of the base is substantially in a hemispherical shape corresponding to the lamp body.

4. The split type LED lamp of claim 1, wherein the lamp body is substantially a strip structure, and the containing groove of the base is substantially in shape of a strip corresponding to the lamp body.

5. The split type LED lamp of claim 1, wherein the first plug portion is a protruding column, and the second plug portion is a groove, such that the first plug portion can be inserted into the second plug portion to complete an electric connection.

6. The split type LED lamp of claim 1, wherein the first plug portion is a groove, and the second plug portion is a protruding column, such that the second plug portion can be inserted into the first plug portion to complete an electric connection.

7. The split type LED lamp of claim 1, wherein the second plug portion further includes a plug switch electrically coupled to the battery and the LED light board, such that after the lamp body and the base are separated, the electric power of the battery can be used for driving the LED light board to emit a light.

* * * * *